US009627798B2

(12) United States Patent
Plant

(10) Patent No.: US 9,627,798 B2
(45) Date of Patent: Apr. 18, 2017

(54) CONNECTOR PART AND CONNECTOR ASSEMBLY FOR USE IN A SEVERE ENVIRONMENT

(71) Applicant: Siemens Aktiengesellschaft, München (DE)

(72) Inventor: Christopher Plant, Lancaster (GB)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 14/891,697

(22) PCT Filed: May 15, 2014

(86) PCT No.: PCT/EP2014/059925
§ 371 (c)(1),
(2) Date: Nov. 17, 2015

(87) PCT Pub. No.: WO2014/195100
PCT Pub. Date: Dec. 11, 2014

(65) Prior Publication Data

US 2016/0126662 A1 May 5, 2016

(30) Foreign Application Priority Data

Jun. 4, 2013 (EP) ..... 13170458

(51) Int. Cl.
*H01R 13/40* (2006.01)
*H01R 13/523* (2006.01)

(52) U.S. Cl.
CPC ..... *H01R 13/523* (2013.01)

(58) Field of Classification Search
CPC ..... F01R 13/523
USPC ..... 439/587
See application file for complete search history.

(56) References Cited

U.S. PATENT DOCUMENTS

| | | | |
|---|---|---|---|
| 4,373,767 | A | 2/1983 | Cairns |
| 5,236,018 | A | 8/1993 | Kobayashi et al. |
| 6,240,971 | B1 | 6/2001 | Monette et al. |
| 2006/0148304 | A1 | 7/2006 | Kennedy et al. |

(Continued)

FOREIGN PATENT DOCUMENTS

| | | |
|---|---|---|
| EP | 0 048 601 A2 | 3/1982 |
| FR | 2 863 113 A1 | 6/2005 |

(Continued)

OTHER PUBLICATIONS

Extended European Search Report dated Oct. 25, 2013.
International Search Report PCT/ISA/210 for International Application No. PCT/EP2014/059925 dated Jun. 10, 2014.

*Primary Examiner* — Javaid Nasri
(74) *Attorney, Agent, or Firm* — Harness, Dickey & Pierce, PLC

(57) ABSTRACT

A connector part for use underwater or in a wet or severe environment, the connector part comprising a pin, projecting axially forwardly from a support, the pin comprising an axially extending electrically conductive portion, an axially extending sleeve comprising fiber reinforced plastic around the conductive portion, a protective layer around the sleeve to prevent exposure of the sleeve to ambient conditions when the pin is exposed to ambient conditions, and an axially extending conductive and impermeable layer between the sleeve and the protective layer.

22 Claims, 2 Drawing Sheets

(56) References Cited

U.S. PATENT DOCUMENTS

| | | | | |
|---|---|---|---|---|
| 2007/0293087 | A1 | 12/2007 | Kennedy et al. | |
| 2008/0293280 | A1 | 11/2008 | Kennedy et al. | |
| 2014/0073176 | A1* | 3/2014 | Plant ..... | H01R 13/523<br>439/519 |

FOREIGN PATENT DOCUMENTS

| | | | |
|---|---|---|---|
| GB | 2192316 | A | 1/1988 |
| GB | 2 420 919 | A | 6/2006 |
| WO | WO-98/45635 | A1 | 10/1998 |

* cited by examiner

CONNECTOR PART AND CONNECTOR ASSEMBLY FOR USE IN A SEVERE ENVIRONMENT

PRIORITY STATEMENT

This application is the national phase under 35 U.S.C. §371 of PCT International Application No. PCT/EP2014/059925 which has an International filing date of May 15, 2014, which designated the United States of America and which claims priority to European patent application number EP13170458.7 filed Jun. 4, 2013, the entire contents of which are hereby incorporated herein by reference.

FIELD

An embodiment of present invention generally relates to a connector part for use underwater or in a wet or severe environment, and/or to a connector assembly including first and second connector parts arranged to be inter-engaged to establish an electrical connection.

BACKGROUND

Electrical connectors for use underwater are known, for example from United Kingdom patent application No. GB-A-2,192,316, to have first and second connector parts in which the first connector part has at least one pin projecting from a support which is inserted into a housing and fixed in place by a retainer ring. The pin has an axially extending conductive copper core surrounded by an insulating sleeve which is arranged to expose an area of the conductive core at or near the tip of the pin for making electrical contact with a contact socket in the second connector part.

The housing extends in a forward axial direction from the support, radially outwardly of the contact pin, for alignment with and to receive a housing of the second connector part during interengagment. This extended housing of the first connector part defines a pin chamber in which the pin extends.

In the de-mated condition this pin chamber is exposed to the external environment and flooded with, for example, sea water. The conductive core at the tip of the pin is then exposed to the external environment, as is the insulating sleeve and the front face of the support.

The second connector part has a seal around an opening for receiving the pin in sealed manner when the first and second parts are inter-engaged, or mated. In the mated condition a portion of the pin near the support remains exposed to the external environment, such as sea water.

Electrical connectors of this type are known as wet mate connectors, because they are capable of being mated when underwater.

Wet mate connectors are used in the oil and gas industry to provide electrical power to electrical submersible pumps (ESPs) or compressors. ESPs are located in subsea wells and require electrical connection though a subsea well head. The ESP has an electric motor supplied by a cable connecting the motor to a wet mate connector at the well head. The cable may be connected to the back end of a first connector part as described above. A second connector part for mating with the first connector part pin is connected at its back end to a cable which is supplied from a remote power source, for example at the surface. The environment in which the first and second connector parts are used is subject to high temperatures, for example as high as 200° C. The environment is also a high pressure one and moreover there may be significant pressure differentials between the back of the support of the first connector part from which the connector pin projects and the pin chamber where the pin projects forwardly from the support. There is a challenge to design connector parts able to handle the high temperatures, high pressures, pressure differentials, and also capable of supplying sufficient power to meet the needs of the downhole equipment.

SUMMARY

Accordingly, the inventors recognize that there is a need for an improved connector part.

This need is met by the features of embodiments of the invention. The dependent claims describe embodiments of the invention.

Viewed from a first aspect, an embodiment of the invention provides a connector part for use underwater or in a wet or severe environment, the connector part comprising a pin projecting axially forwardly from a support, the pin comprising an axially extending electrically conductive portion, an axially extending sleeve comprising fibre reinforced plastic around said conductive portion, and a protective layer around the sleeve to prevent exposure of the sleeve to ambient conditions when the pin is exposed to ambient conditions.

At least one embodiment of the invention also provides a connector assembly comprising a connector part as disclosed herein, and a second connector part arranged to be inter-engaged with the first-mentioned connector part to establish an electrical connection. The second connector part may have a seal around an opening for receiving the pin in sealed manner when the first and second connector parts are inter-engaged.

Viewed from a second aspect, an embodiment of the invention provides a connector part for use underwater or in a wet or severe environment, the connector part comprising a pin projecting axially forwardly from a support, and the pin comprising an axially extending electrically conductive portion, a first axially extending insulating layer around the conductive portion, a second axially extending insulating layer around the first insulating layer, and an axially extending conductive and impermeable coating between the first and second insulating layers.

At least one embodiment of the invention also provides a connector assembly comprising a connector part in accordance with the second aspect of the invention, and a second connector part arranged to be inter-engaged with the first-mentioned connector part to establish an electrical connection. The second connector part may have a seal around an opening for receiving the pin in sealed manner when the first and second connector parts are inter-engaged.

A method of depositing the metal coating on the pin may comprise etching the surface to which it is to be applied, to provide a key, and depositing the metal layer on the keyed surface by a suitable deposition process. Preferably, after the surface is etched an activator is applied to the surface before the coating is applied.

BRIEF DESCRIPTION OF THE DRAWINGS

Features of embodiments of the invention can be combined with each other unless noted to the contrary.

Certain preferred embodiments of the invention will now be described by way of example and with reference to the accompanying drawings, in which like reference numerals refer to like elements and in which.

DETAILED DESCRIPTION OF EXAMPLE EMBODIMENTS

Figure 1:
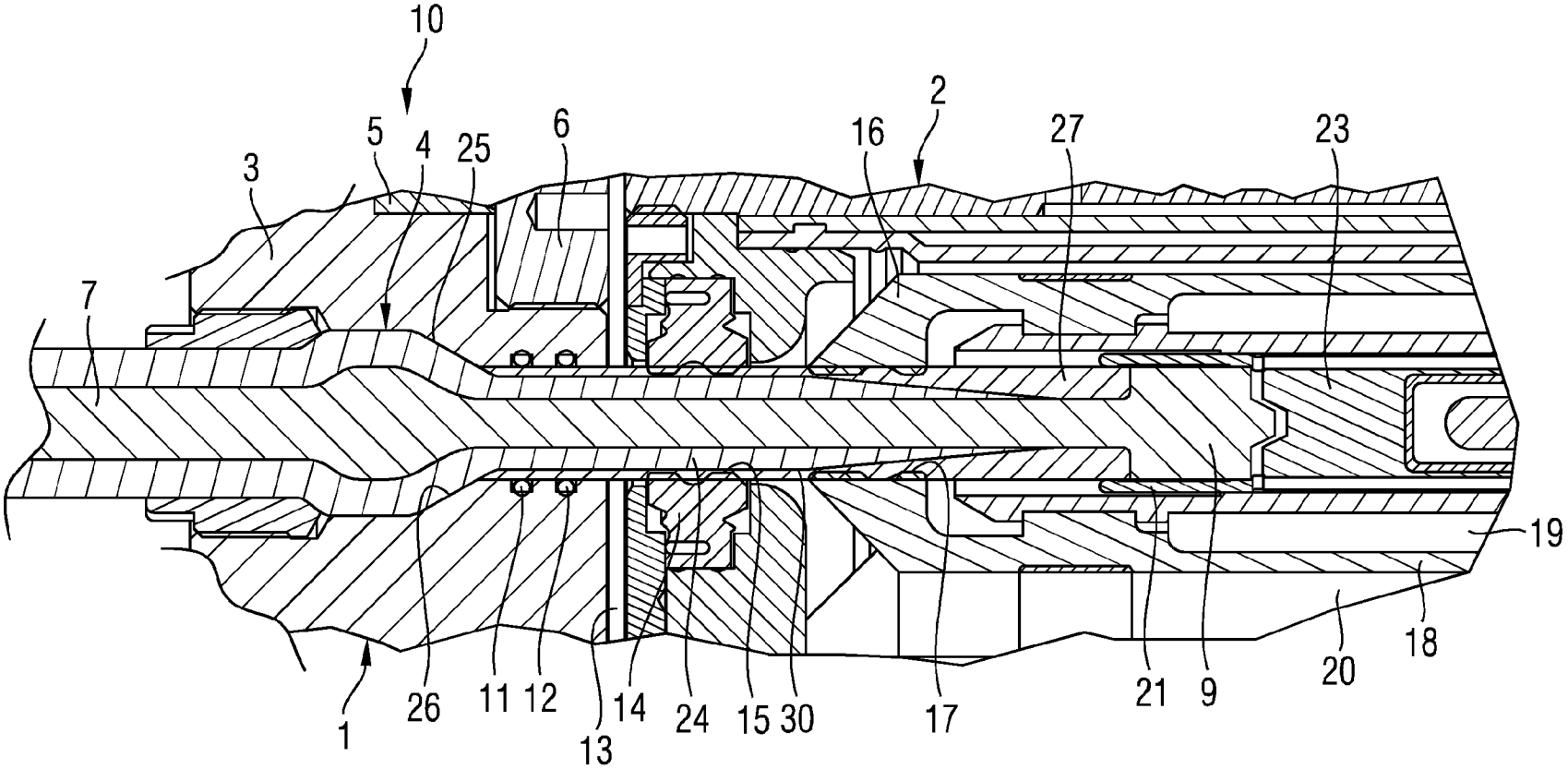
FIG. 1 shows an axial cross-sectional view of the interengaging parts of a connector assembly.

Viewed from a first aspect, an embodiment of the invention provides a connector part for use underwater or in a wet or severe environment, the connector part comprising a pin projecting axially forwardly from a support, the pin comprising an axially extending electrically conductive portion, an axially extending sleeve comprising fibre reinforced plastic around said conductive portion, and a protective layer around the sleeve to prevent exposure of the sleeve to ambient conditions when the pin is exposed to ambient conditions.

By providing a sleeve comprising fibre reinforced plastic the pin has good load bearing properties. In particular, it may provide a good pressure loading performance when used underwater at depths where high pressure prevails.

The protective layer around the sleeve prevents exposure of the sleeve to ambient conditions when the pin is exposed to ambient conditions. The pin may be exposed along its full projecting length when the connector part is not mated with a second connector part, and it may be exposed in the region of the support even when it is mated. Whilst the sleeve comprising fibre reinforced plastic has good load bearing properties, it is generally undesirable for it to be exposed to e.g. sea water, and hence is protected by the protective layer.

The sleeve may comprise a fibre filled polymer. The fibre reinforcement may be glass fibre. The fibre content in the fibre reinforced plastic may be between about 20% and about 60%, preferably between about 30% and about 50%, more preferably about 40% (weight percent). In one example, the sleeve comprises polyetherketoneketone (PEKK). It may be provide with a 40 percent glass fibre content.

The protective layer may comprise a plastic or polymer. The protective layer may have no fibre reinforcement. The protective layer may comprise an engineering polymer. The protective layer may comprise a polyaryletherketone (PAEK), such as polyetheretherketone (PEEK) or polyetherketoneketone (PEKK), for example.

The protective layer may cover all of the axial length of the sleeve where it projects axially forwardly from the support. In embodiments, none of the sleeve is exposed to ambient conditions when the pin is so exposed.

The conductive portion may have an electrical contact which is exposed. The electrical contact may be provided at or adjacent to the front end of the axially extending electrically conductive portion. The electrical contact can make an electrical connection when the connector part is mated with a second connector part. Thus, in an embodiment, when the connector part is not mated and the pin is exposed to ambient conditions, the protective layer and the contact region of the conductive portion may be exposed to ambient conditions, but not the sleeve comprising fibre reinforced plastic.

The sleeve may extend forwardly of the support over only part of the length of the pin which projects axially forwardly therefrom. The mechanical properties of the sleeve are most advantageous in the region of the pin adjacent to the support, where it is beneficial to provide additional strength. The protective layer may extend at least from the support to the electrical contact of the pin. The sleeve may extend forwardly over only part of this length.

The pin may extend in the support, as well as projecting axially forwardly therefrom. The pin may comprise a shoulder disposed in the support to prevent forward movement of the pin relative to the support. This is useful for example if there is a pressure differential between the back end of the pin and the part of the pin exposed to ambient conditions, which may tend to force the pin forwardly. The shoulder may prevent forward movement of the pin relative to the support under such a pressure differential.

The sleeve may comprise a load bearing portion at the shoulder. The shoulder is a place where the pin can particularly benefit from a sleeve comprising fibre reinforced plastic, in view of the relative strength of such a material compared to non-fibre reinforced polymers.

In the embodiments in which the pin extends in the support, sealing devices may be provided around an opening in the support from which the pin projects forwardly. The sealing devices may comprise one or more seal members. The or each seal member may be an O-ring, for example.

The protective layer serves the purpose of protecting the sleeve from ambient conditions where the pin is exposed thereto. The protective layer need not necessarily therefore extend into the support, or it may extend only a short distance into the support. The protective layer may extend rearwardly into the support to engage with the above mentioned sealing means. Rearwardly of the sealing means, the sleeve will generally not require protection from ambient conditions.

Where the pin comprises a shoulder disposed in the support, and the sleeve comprises a load bearing portion at the shoulder, the protective layer may extend over the shoulder. It may act as a compressible layer at the shoulder, for example in the manner of a washer. If the protective layer extends over the shoulder, this shoulder extending portion may be thinner than the protective layer where it is provided on the pin forwardly of the support.

In certain embodiments a conductive impermeable layer is provided between the sleeve and the protective layer.

The conductive impermeable layer may be a coating. The coating may be deposited on the surface of the sleeve. It may be applied to the surface of the sleeve. A coating differs from a separately fabricated metal tube. The coating may be a metal coating, for example metal plating or a metallic paint.

The protective layer may be moulded over the sleeve. If a conductive impermeable coating is provided, then the coating is first deposited on the sleeve before the protective layer is moulded over the coated sleeve. The coating preferably therefore is capable of withstanding temperatures at which the protective layer is moulded, for example between 350° C. to 390° C. in the case of PEAK polymer.

The conductive impermeable layer, e.g. metal coating, is impermeable to water. It may therefore protect the sleeve from long term degradation due to water. The conductive impermeable layer does not have to be corrosion resistant, because it is covered by the protective layer. The conductive impermeable layer may serve to control the electric field generated by the axially extending electrically conductive portion when the connector part is in use.

The conductive impermeable layer may extend annularly round the sleeve. The conductive impermeable layer may extend axially.

The conductive impermeable layer may extend axially rearwardly of the protective layer. The conductive impermeable layer may have a front portion extending forwardly of the support, located between the sleeve and the protective layer, and a rear portion extending in the support disposed on the protective layer and forming an outside surface of the pin.

At least one embodiment of the invention also provides a connector assembly comprising a connector part as disclosed herein, and a second connector part arranged to be inter-engaged with the first-mentioned connector part to establish an electrical connection. The second connector part may have a seal around an opening for receiving the pin in sealed manner when the first and second connector parts are inter-engaged.

In the embodiments in which a conductive impermeable layer is provided, it is advantageous if the conductive impermeable layer extends along the pin in a region which, when the first and second connector parts are inter-engaged, is disposed radially inwardly of the seal of the second connector part. This can provide effective electrical field control in this region, thereby protecting the seal from electrical stresses. The front of the seal (the front being considered with respect to the second connector part) is generally exposed to ambient conditions, such as seawater, whether the connector assembly is mated or de-mated. Therefore, in the absence of any conductive impermeable layer in the pin, the front of the seal would be subject to high electrical stress. This is because ambient water is at an earth potential, causing electrical stress concentration in the seal material where the front of the seal engages with the pin. The electrical stress is concentrated where the water at earth potential meets the axially extending surface of the pin and the radially extending surface of the seal.

The use of a conductive impermeable layer, for example a metal coating, in this region can thus provide effective electrical stress control. It is possible to avoid or minimize concentration of electrical stress where the water at earth potential meets the axially extending surface of the pin and the radially extending surface of the seal. The conductive impermeable layer is provided internally of the pin, between the sleeve and the protective layer. In the case of a coating, it is relatively easy to deposit and hence advantageous compared to using a fabricated metal tube, such as a tubular mesh.

Viewed from a second aspect, an embodiment of the invention provides a connector part for use underwater or in a wet or severe environment, the connector part comprising a pin projecting axially forwardly from a support, and the pin comprising an axially extending electrically conductive portion, a first axially extending insulating layer around the conductive portion, a second axially extending insulating layer around the first insulating layer, and an axially extending conductive and impermeable coating between the first and second insulating layers.

The conductive impermeable coating can protect the first insulating layer and can also control the electrical field. The first insulating layer is able to tolerate the electrical stresses around the conductive portion of the pin under such protected conditions. The second insulating layer, radially outwardly of the conductive impermeable coating, is protected from electrical stress and can serve the purpose of protecting the layer inwardly thereof from ambient conditions. It need not be designed to withstand significant electrical stresses, in view of the conductive impermeable coating radially inwardly thereof.

In an embodiment, the conductive impermeable coating may be deposited on the surface of the first insulating layer. It may be applied to the surface of the first insulating layer. A coating differs from a separately fabricated metal tube. By using a conductive impermeable coating, it is not necessary to mold a fabricated metal tube, such as a tubular mesh, into the pin.

In an embodiment, the conductive impermeable coating may be a metal coating, for example metal plating or a metallic paint.

The conductive impermeable coating, e.g. metal coating, is impermeable to water. It may therefore protect the first insulating layer from long term degradation due to water. The conductive impermeable coating does not have to be corrosion resistant, because it is covered by the second insulating layer. The conductive impermeable coating may serve to control the electric field generated by the axially extending electrically conductive portion when the connector part is in use.

The conductive impermeable coating may extend annularly round the sleeve.

The first and second insulating layers may comprise the same material as each other.

The first and second insulating layers may comprise different materials. They may for example comprise two different polymers. The material of the first layer may be selected for its electrical insulation properties or its mechanical strength, and the material of the second layer may be selected for its ability to withstand exposure to an aggressive environment, for example.

At least one embodiment of the invention also provides a connector assembly comprising a connector part in accordance with the second aspect of the invention, and a second connector part arranged to be inter-engaged with the first-mentioned connector part to establish an electrical connection. The second connector part may have a seal around an opening for receiving the pin in sealed manner when the first and second connector parts are inter-engaged.

It is advantageous if the conductive impermeable coating extends along the pin in a region which, when the first and second connector parts are inter-engaged, is disposed radially inwardly of the seal of the second connector part. This can provide effective electrical field control in this region, thereby protecting the seal from electrical stresses. The front of the seal (the front being considered with respect to the second connector part) is generally exposed to ambient conditions, such as seawater, whether the connector assembly is mated or de-mated. Therefore, in the absence of any conductive impermeable coating in the pin, the front of the seal would be subject to high electrical stress. This is because ambient water is at an earth potential, causing electrical stress concentration in the seal material where the front of the seal engages with the pin. The electrical stress is concentrated where the water at earth potential meets the axially extending surface of the pin and the radially extending surface of the seal.

The use of a conductive impermeable coating in this region can thus provide effective electrical stress control. It is possible to avoid or minimize concentration of electrical stress where the water at earth potential meets the axially extending surface of the pin and the radially extending surface of the seal. The conductive impermeable coating is provided internally of the pin, between the first and second insulating layers. It is relatively easy to deposit and hence advantageous compared to using a fabricated metal tube, such as a tubular mesh.

In embodiments of the first or second aspects of the invention having a metal coating, the metal coating may comprise one coating layer or a plurality of coating layers, e.g. two coating layers. Thus there may be a base layer and a top layer. The coating may comprise a base layer of copper and a top layer of nickel.

The metal coating may comprise a base layer preferably less than 20 μm thick. Such a base layer may for example be copper. The base layer may be less than 15 μm thick, or less than 12 μm thick, or less than 10 μm thick, or less than 5 μm thick.

The metal coating may also comprise a top layer less than 20 μm thick. Such a top layer may for example be nickel. The top layer may be less than 15 μm thick, or less than 12 μm thick, or less than 10 μm thick, or less than 5 μm thick. The total thickness of the coating, whether it is made up of one coating layer or a plurality of coating layers, is preferably less than 100 μm, more preferably less than 75 μm or 50 μm or 40 μm or 30 μm or 20 μm or 10 μm. A thickness in the range of 10 μm to 30 μm, more preferably 15 μm to 25 μm is preferred.

A method of depositing the metal coating on the pin may comprise etching the surface to which it is to be applied, to provide a key, and depositing the metal layer on the keyed surface by a suitable deposition process. Preferably, after the surface is etched an activator is applied to the surface before the coating is applied.

The connector part and the connector assembly of both aspects of the invention may be suitable for use subsea. They may for example be used to supply power to a subterranean or subsea well. They may be used to supply power to an ESP or a compressor. They may be used to supply power to downhole equipment. The first-mentioned connector part may be connected at its back end to a cable leading to the equipment, and the second connector part may be connected at its back end to a power supply. The connector part, and the connector assembly, may be suitable for withstanding high temperatures and high pressures. The first mentioned connector part may be suitable for withstanding a high pressure differential between the pin where it projects from the support and a back end of the pin disposed in the support, such pressure differentials tending to urge the pin forwardly relative to the support.

FIG. 1 shows a connector assembly 10 comprising a first connector part 1 and a second connector part 2. The first connector part has a support 3 from which a connector pin 4 projects forwardly. The support is retained in a housing 5 of the first connector part 1 by a retaining member 6. The connector pin 4 has a rear portion carried in the support 3 and an axially forwardly projecting portion disposed forwardly of the support. The pin 4 has an axially extending conductive portion or core 7 which at its rear end provides a rear electrical contact 8 for engagement in a socket of a crimp or the like (not shown). At its front end the conductive core 7 has a front electrical contact 9. A pair of O-ring seals 11, 12 are provided near the front of the support 3 to seal the rear portion of the pin against water ingress.

The connector assembly is shown in the mated condition, with a small portion of the connector pin 4 being exposed to ambient conditions, such as seawater, in a region between the first connector part 1 and the second connector part 2.

The second connector part 2 comprises an outer seal 14 defining an opening 15 through which the connector pin 4 extends into the second connector part 2. The outer seal 14 forms a primary barrier against water ingress. Axially rearwardly of the seal 14 (with respect to the second connector part) a second, inner seal 16 defines a second opening 17, through which the pin 4 also passes in the mated condition of the connector assembly. The seal 16 is part of an elastomeric molding which includes a flexible membrane 18 defining inwardly thereof a fluid filled chamber 19 which is able to provide pressure compensation of the chamber 19 with respect to another chamber 20 provided on the outside of the membrane 18. This chamber 20 is also fluid filled and extends between the first seal 14 and the second seal 17, as well as outwardly of the membrane 18. The outer chamber 20 is defined inwardly of a flexible membrane 23. The outer surface of the flexible membrane 23 is exposed to ambient pressure. Therefore, the outer chamber 20 is pressure balanced with respect to ambient conditions, and the inner chamber 19 is pressure balanced with respect to the outer chamber 20. Such pressure balancing tends to inhibit ingress of water or other contaminants into the second connector part 2, whether mated or de-mated.

Chamber 20 is thus a first, outer chamber, and chamber 19 is a second, inner chamber. Inside the inner chamber 19 an electrical contact socket 21 is provided for receiving the front electrical contact 9 of the connector pin 4 of the first connector part 1.

A forwardly spring biased shuttle piston 22 is provided in the second connector part 2. This is shown, in the mated condition of the connector assembly, pushed to a rearward position by the connector pin 4. In the unmated condition of the connector assembly, the shuttle piston 22 extends forwardly through the electrical contact socket 21, through the inner seal 16, and through the outer seal 15. It is biased forwardly by a spring (not shown) and held in this position to maintain the sealing integrity of the second connector part when the parts are not mated. The front end of the shuttle piston 22 in the unmated condition of the assembly is generally flush with the front of the outer seal 14.

Figure 2:
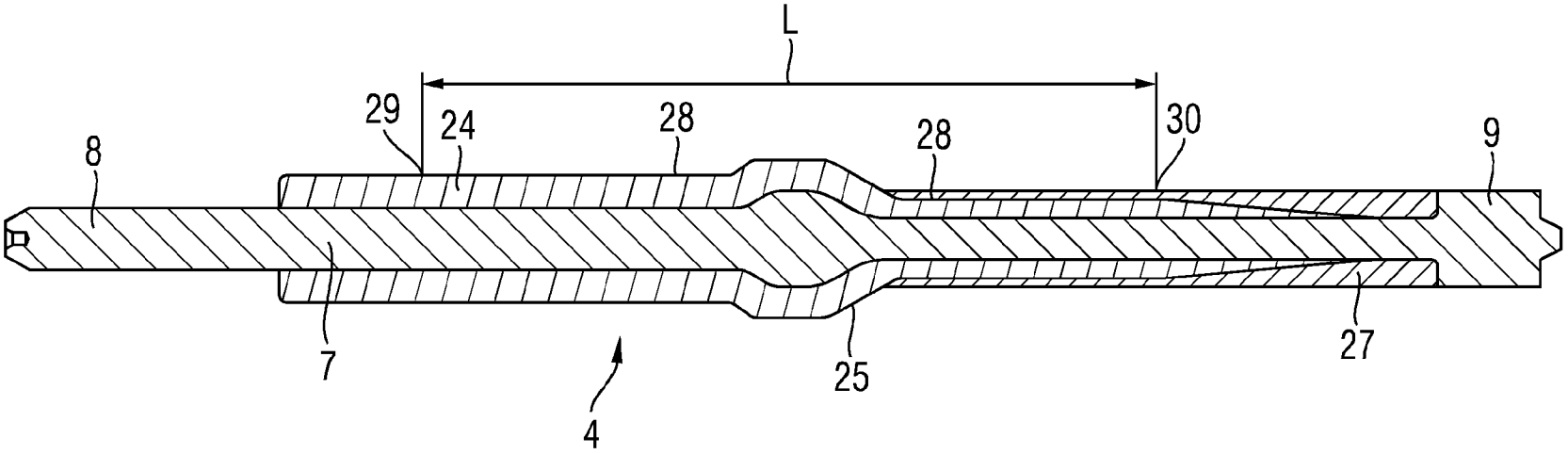
FIG. 2 shows an axial cross-sectional view of a pin belonging to a first connector part of the connector assembly.

Further details of the connector pin 4 are described with reference to FIG. 2. The conductive core 7 extends forwardly from the rear electrical contact 8 to the front electrical contact 9. A glass fiber reinforced plastic or polymer sleeve 24 is provided around the conductive core 7 and extends along the full length of the core other than the rear and front electrical contacts 8 and 9. The sleeve extends annularly round the core. In this embodiment, by way of example, the sleeve comprises a PEKK polymer and glass fiber. In this embodiment the polymer is filled with 40% glass fiber. The sleeve 24 provides the pin with mechanical strength. The pin has a load shoulder 25, having a generally conical configuration, increasing in diameter in a rearward direction. As seen in FIG. 1, the load shoulder 25 engages against a corresponding conical shoulder 26 in the support 3 of the first connector part 1. The mechanical strength of the sleeve 24 provides a benefit in this load bearing region. If the connector assembly is used in conditions where the pressure at the rear of the pin is greater than the pressure at the front of the pin, then the pin experiences a forward thrust force. This is resisted by the load shoulder 25 of the pin engaging the corresponding load bearing surface 26 of the support 3.

The pin 4 has a protective layer provided around the sleeve 24 where it extends forwardly of the support. This protective layer 27 serves to protect the sleeve 24 from ambient conditions. The protective layer 27 extends annularly round the sleeve 24. It may be made of a polymer such as PEKK or PEEK, which is not provided with any fiber reinforcement, i.e. an unfilled polymer. The protective layer 27 extends forwardly to the front electrical contact 9. In this embodiment it extends rearwardly sufficiently far for it to be engaged by the seals 11 and 12 of the support 3. Therefore, the sleeve 24 to the rear of the protective layer 27 is not exposed to ambient conditions. The seals 11, 12 define a region axially rearwardly thereof which is sealed from ambient conditions.

The protective layer 27 has a rear end at the front of the load shoulder 25 of the pin 4. In alternative embodiments, the protective layer 27 can extend over the load shoulder. It may therefore provide a compressible layer, or washer, around the load shoulder.

A metal coating 28 is provided over the sleeve 24, along a length of the sleeve shown as "L". The metal coating extends from a rear end 29 over the length L to a front end 30. The front end 30 is surrounded by the protective layer 27 so that in use the high electrical stresses at the front end 30 are contained in the material of the protective layer 27. This material is preferably molded over the sleeve 24 after the metal coating 28 has been applied thereto and so there should be no trapped air in this region of high electrical stress.

The coating 28 is impermeable to water and, in addition to the protective layer 27, provides protection to the sleeve 24 inwardly thereof. As seen in FIG. 1, the metal coating extends axially across the part of the pin which is exposed at 13 to ambient conditions even when the connector parts are mated. Thus the metal coating 28 can protect the sleeve 24 from long term degradation when the connector is mated in the field.

The metal coating serves to control the electrical field around the conductive core 7. It will be seen in FIG. 1 that the metal coating extends axially along the part of the pin that extends through the opening 15 defined by the seal 14 of the second connector part 2. Therefore the metal coating 28 protects the seal 14 from high electrical stresses.

In this embodiment the sleeve 24 and the protective layer 27 are made of different materials, the sleeve 24 being for providing mechanical strength and the protective layer 27 being for providing protection against ambient conditions. However, in alternative embodiments of the second aspect of the invention, the two layers 24 and 27 may be made of the same material, or of two different materials neither of which contains fiber reinforcement. The metal coating then used between the two layers provides an impermeable barrier to provide some protection for the inner layer. The metal coating also provides an electrical shield to the region radially outwardly thereof. It is easy to apply a metal coating to the inner layer during construction, compared to the use of a metal tube such as a metal mesh which has to be separately fabricated.

While specific embodiments of the invention are disclosed herein, various changes and modifications can be made without departing from the scope of the invention. The present embodiments are to be considered in all respect as illustrative and non-restrictive, and all changes coming within the meaning and equivalency range of the appended claims are intended to be embraced therein.

The following clauses set out features of the invention which may not presently be claimed in this application, but which may form the basis for future amendment or a divisional application:

A connector part for use underwater or in a wet or severe environment, the connector part comprising a pin projecting axially forwardly from a support, and the pin comprising an axially extending electrically conductive portion, a first axially extending insulating layer around the conductive portion, a second axially extending insulating layer around the first insulating layer, and an axially extending conductive and impermeable coating between the first and second insulating layers.

In an embodiment, the first and second layers may comprise the same material. In another embodiment, the first and second layers may comprise different materials.

The conductive impermeable coating may comprises a metal coating.

A connector assembly comprising a connector part as outlined in the preceding clauses, and a second connector part arranged to be inter-engaged with the first-mentioned connector part to establish an electrical connection.

In an embodiment, the second connector part has a seal around an opening for receiving the pin in sealed manner when the first and second connector parts are inter-engaged.

The conductive and impermeable coating may extend along the pin in a region which, when the first and second connector parts are inter-engaged, is disposed radially inwardly of the seal.

The invention claimed is:

1. An electrical connector part of an electrical connector for use underwater or in a wet or severe environment, the electrical connector part comprising:

a pin, projecting axially forwardly from a support, the pin including an axially extending electrically conductive portion;

an axially extending sleeve including fiber reinforced plastic around said conductive portion; and a protective layer around the sleeve to prevent exposure of the sleeve to ambient conditions when the pin is exposed to ambient conditions, wherein the electrically conductive portion comprises a core axially extending through, and forwardly and rearwardly beyond, the protective layer.

2. The electrical connector part of claim 1, wherein the pin comprises a shoulder disposed in the support to prevent forward movement of the pin relative to the support.

3. The electrical connector part of claim 2, wherein the sleeve comprises a load bearing portion at the shoulder.

4. The electrical connector part of claim 1, wherein the sleeve comprises a fiber filled polymer.

5. The electrical connector part of claim 1, wherein the fiber reinforcement comprises glass fibers.

6. The electrical connector part of claim 1, wherein the fiber content in the fiber reinforced plastic is between about 20% and about 60%.

7. The electrical connector part of claim 1, wherein the protective layer comprises a plastic or a polymer, in particular an engineering polymer.

8. The electrical connector part of claim 1, wherein the protective layer does not have fiber reinforcement.

9. The electrical connector part of claim 1, wherein the protective layer comprises a polyaryletherketone (PAEK).

10. The electrical connector part of claim 1, comprising a conductive impermeable layer between the sleeve and the protective layer.

11. The electrical connector part of claim 10, wherein the conductive impermeable layer extends axially rearwardly of the protective layer.

12. The electrical connector part of claim 10, wherein the conductive impermeable layer comprises a metal coating.

13. An electrical connector assembly comprising:

the electrical connector part of claim 1; and a second electrical connector part engaged with the electrical connector part of claim 1, to establish an electrical connection.

14. The electrical connector assembly of claim 13, wherein the second electrical connector part includes a seal around an opening to receive the pin in sealed manner when the first and second electrical connector parts are inter-engaged.

15. The electrical connector assembly of claim 14, wherein the electrical connector part further comprises a conductive impermeable layer between the sleeve and the protective layer, and wherein the conductive impermeable layer extends along the pin in a region which, when the first and second electrical connector parts are inter-engaged, is disposed radially inwardly of the seal of the second electrical connector part.

16. The electrical connector part of claim 1, wherein the fiber reinforcement consists of glass fibers.

17. The electrical connector part of claim 6, wherein the fiber content in the fiber reinforced plastic is between about 30% and about 50%.

18. The electrical connector part of claim 17, wherein the fiber content in the fiber reinforced plastic is about 40%.

19. The electrical connector part of claim 9, wherein the protective layer comprises polyetheretherketone (PEEK) or polyetherketoneketone (PEKK).

20. The electrical connector part of claim 1, wherein the protective layer consists of a polyaryletherketone (PAEK).

21. The electrical connector part of claim 20, wherein the protective layer consists of polyetheretherketone (PEEK) or polyetherketoneketone (PEKK).

22. The electrical connector part of claim 11, wherein the conductive impermeable layer comprises a metal coating.

* * * * *